US009702200B2

(12) United States Patent
Bowley et al.

(10) Patent No.: US 9,702,200 B2
(45) Date of Patent: Jul. 11, 2017

(54) SYSTEM AND METHOD FOR CONTROLLED SLIP CONNECTION

(71) Applicant: TESCO CORPORATION, Houston, TX (US)

(72) Inventors: Ryan Thomas Bowley, Calgary (CA); Edgar Fernando Yajure, Calgary (CA)

(73) Assignee: Tesco Corporation, Houston, TX (US)

( * ) Notice: Subject to any disclaimer, the term of this patent is extended or adjusted under 35 U.S.C. 154(b) by 473 days.

(21) Appl. No.: 14/284,183

(22) Filed: May 21, 2014

(65) Prior Publication Data

US 2015/0337606 A1 Nov. 26, 2015

(51) Int. Cl.

| | |
|---|---|
| ***E21B 17/02*** | (2006.01) |
| ***E21B 41/00*** | (2006.01) |
| ***E21B 47/022*** | (2012.01) |
| ***E21B 7/06*** | (2006.01) |

(52) U.S. Cl.

CPC ..... *E21B 17/02* (2013.01); *E21B 7/062* (2013.01); *E21B 7/067* (2013.01); *E21B 41/0085* (2013.01); *E21B 47/022* (2013.01)

(58) Field of Classification Search

CPC ..... E21B 41/0085; E21B 7/067; E21B 7/062
See application file for complete search history.

(56) References Cited

U.S. PATENT DOCUMENTS

| | | | | |
|---|---|---|---|---|
| 3,599,733 | A * | 8/1971 | Varley | E21B 7/065 175/318 |
| 4,211,291 | A * | 7/1980 | Kellner | E21B 4/00 173/DIG. 4 |
| 4,407,374 | A * | 10/1983 | Wallussek | E21B 4/02 175/24 |
| 5,265,682 | A | 11/1993 | Russell et al. | |
| 6,129,160 | A * | 10/2000 | Williams | E21B 4/02 175/107 |
| 7,510,031 | B2 * | 3/2009 | Russell | E21B 41/0085 175/170 |
| 7,866,416 | B2 * | 1/2011 | Hall | E21B 7/06 175/104 |
| 9,322,218 | B2 * | 4/2016 | Russell | E21B 4/02 |
| 2006/0243487 | A1 * | 11/2006 | Turner | E21B 7/062 175/26 |
| 2007/0151767 | A1 | 7/2007 | Downton | |
| 2008/0121432 | A1 * | 5/2008 | Russell | E21B 41/0085 175/73 |
| 2012/0118646 | A1 * | 5/2012 | Russell | E21B 4/02 175/73 |
| 2015/0101864 | A1 * | 4/2015 | May | E21B 44/00 175/27 |

FOREIGN PATENT DOCUMENTS

| | | |
|---|---|---|
| CN | 103758455 | 4/2014 |

OTHER PUBLICATIONS

PCT International Search Report and Written Opinion dated Oct. 1, 2015.

* cited by examiner

*Primary Examiner* — Shane Bomar
(74) *Attorney, Agent, or Firm* — Fletcher Yoder, P.C.

(57) ABSTRACT

A controlled slip connection system is configured to be coupled between a drill pipe and a directional drilling assembly, and the slip connection system is configured to enable continual rotation of the drill pipe while providing a rotationally stationary surface for a mud motor of the directional drilling assembly to react against.

17 Claims, 3 Drawing Sheets

SYSTEM AND METHOD FOR CONTROLLED SLIP CONNECTION

FIELD OF DISCLOSURE

The present disclosure relates generally to the field of well drilling operations. More specifically, embodiments of the present disclosure relate to a controlled slip-able connection (controlled slip connection) for use with down-hole components in a down-hole environment.

BACKGROUND

In conventional oil and gas operations, a well is typically drilled to a desired depth with a drill string, which includes drill pipe and a drilling bottom hole assembly (BHA). In certain applications, directional drilling techniques may be used for drilling wells with non-vertical (e.g., horizontal, curved, or angled) sections. Traditionally, when creating or drilling a non-vertical portion of a directional drill hole using a mud motor style setup, a bent axis motor-bit assembly is held stationary using the torsional resistance of the drill string from the top of the hole. As the drilling length increases, the drill pipe becomes more and more flexible making it more difficult to hold the rotational orientation of the drill bit and mud motor. It is now recognized that, once in the non-vertical (e.g., horizontal) section of a well hole, it becomes difficult to keep weight on the bit as the stationary pipe tends to stick and bind in the hole. This is not as prevalent during straight line or vertical motion as the drill pipe is rotated along with the drill bit so the static friction is broken and the more slippery dynamic friction takes over, which allows the pipe to slide more freely and keep the weight on the bit more constant.

BRIEF DESCRIPTION

In a first embodiment, a device includes controlled slip connection system configured to be coupled between a drill pipe and a directional drilling assembly, wherein the slip connection system is configured to enable continual rotation of the drill pipe while providing a rotationally stationary surface for a mud motor of the directional drilling assembly to react against.

In a second embodiment, a controlled slip connection system includes a pump section configured to couple to a drill pipe, a hydraulic section coupled to the pump section, and a controller section coupled to the hydraulic section, wherein the controller section is configured to couple to a mud motor of a directional drilling assembly, and wherein the controlled slip connection system is configured to slip at a rotational rate of the drill pipe.

In a third embodiment, a method of positioning a drill string within a wellbore includes detecting an orientation of a controlled slip connection system coupled between a drill pipe and a mud motor of the drill string with at least one sensor, adjusting a flow rate of hydraulic fluid in a hydraulic fluid circuit in fluid communication with a hydraulic pump coupled to the drill pipe with a controller, rotating the drill pipe, and pumping a drilling mud flow through the drill pipe and the controlled slip connection system to the mud motor.

DRAWINGS

These and other features, aspects, and advantages of the present disclosure will become better understood when the following detailed description is read with reference to the accompanying drawings in which like characters represent like parts throughout the drawings, wherein.

Figure 3:
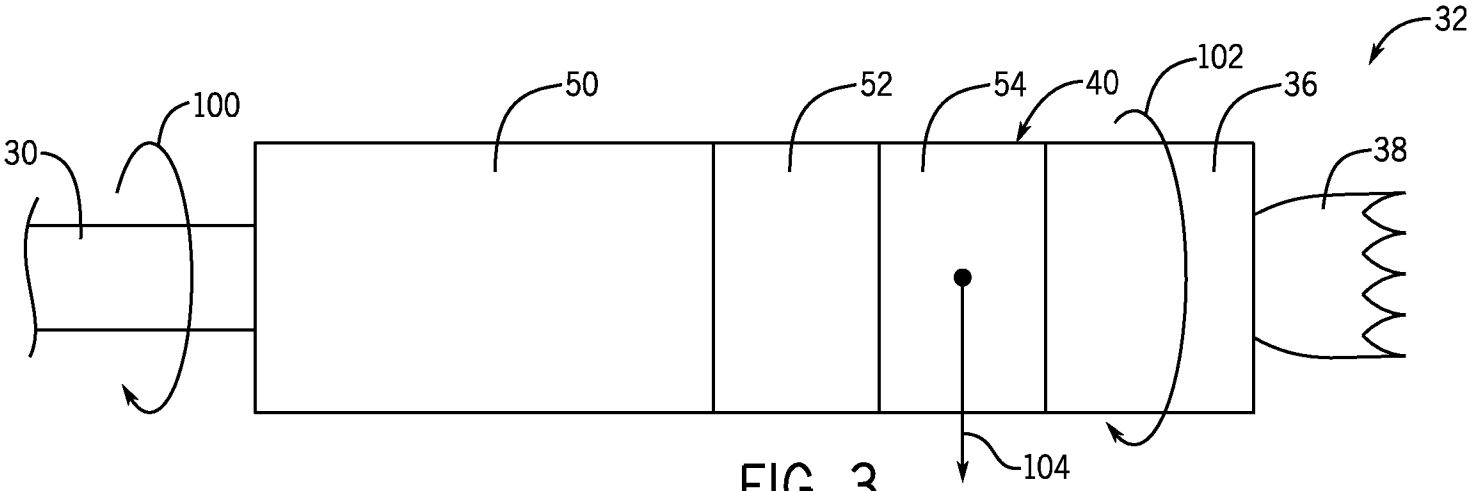
Figure 4:
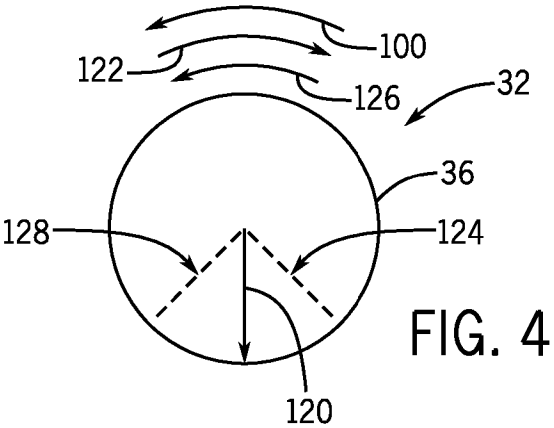

FIG. 3 is a free body diagram of an embodiment of a bottom hole assembly having a controlled slip connection system coupled between a drill string and a mud motor, in accordance with aspects of the present disclosure; and FIG. 4 is a free body diagram of an embodiment of bottom hole assembly having a controlled slip connection system coupled between a drill string and a mud motor, in accordance with aspects of the present disclosure.

DETAILED DESCRIPTION

The present disclosure relates generally to a device and method that provides a controlled slip-able connection (or controlled slip connection) between an upper portion of a drill string and a directional drilling assembly (e.g., a mud motor and drill bit). The controlled slip-able connection is configured to allow the upper portion of the drill string (e.g., drill pipe), which is normally rotationally stationary during directional maneuvers, to continually rotate, which provides the desirable dynamic friction realm that is available during straight or vertical drilling runs. As discussed in detail below, the controlled slip connection also provides a rotationally stationary surface for a mud motor to react against regardless of the drill string's (e.g., the upper portion of the drill string or drill pipe) speed of rotation or position. The controlled slip connection may include an electrical generator with a controlled variable resistive load, a mechanical clutch with control over a breaking torque or other energy reducing rotary connection, a vane motor with control or metering valve that throttles a hydraulic fluid to control slip or rotation of the controlled slip connection, a constant or variable displacement hydraulic pump, or other component configured to enable and control absorption of torque and/or torque transfer from the upper portion of the drill string. As a result, the drill string may be rotated during a directional drilling operation, while the directional drilling assembly (e.g., mud motor and drill bit) remains stationary, which may reduce static friction between the drill string and the wellbore and help modify (e.g., reduce) the weight (e.g., force) of the drill string acting on the mud motor and drill bit.

Figure 1:
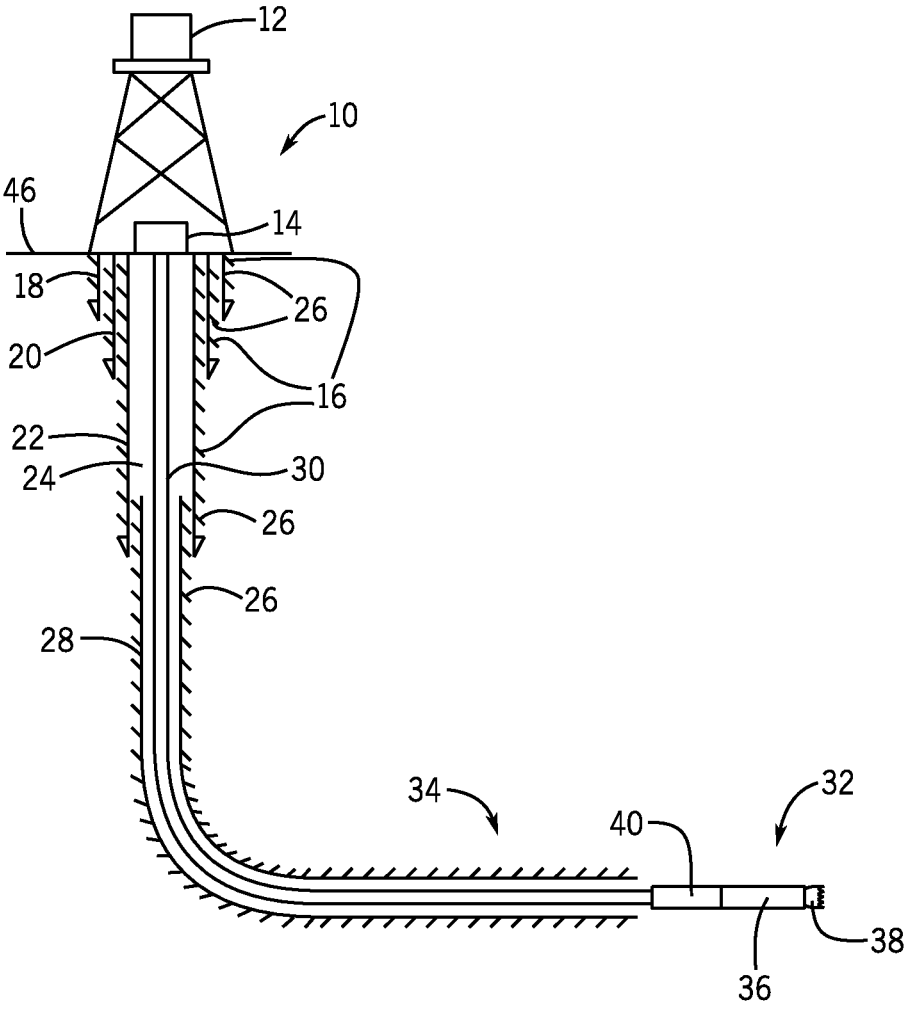
FIG. 1 is a schematic representation of a well being drilled, in accordance with aspects of the present disclosure.

Turning now to the drawings, FIG. 1 is a schematic representation of a well 10 using a drill string having a controlled slip connection system. In the illustrated embodiment, the well 10 includes a derrick 12, wellhead equipment 14, and several levels of casing 16 (e.g., pipe). For example, the well 10 includes a conductor casing 18, a surface casing 20, and an intermediate casing 22. In certain embodiments, the casing 16 may include 30 foot segments of oilfield pipe having a suitable diameter (e.g., 13⅜ inches) that are joined as the casing 16 is lowered into a wellbore 24 of the well 10. As will be appreciated, in other embodiments, the length and/or diameter of segments of the casing 16 may be other lengths and/or diameters. The casing 16 is configured to isolate and/or protect the wellbore 24 from the surrounding subterranean environment. For example, the casing 16 may isolate the interior of the wellbore 24 from fresh water, salt water, or other minerals surrounding the wellbore 24.

The casing 16 may be lowered into the wellbore 24 with a running tool. As shown, once each level of casing 16 is lowered into the wellbore 24 of the well, the casing 16 is secured or cemented in place with cement 26. For example, the cement 26 may be pumped into the wellbore 24 after each level of casing 16 is landed in place within the wellbore 24. Furthermore, the well 10 may include a liner 28 disposed within the wellbore 24 and the casing 16 (e.g., the intermediate casing 22) and held in place by cement 26. Specifically, the liner 28 may be hung from the casing 16 (e.g., the intermediate casing 22) within the wellbore 24. With the levels of casing 16 and the liner 28 in place, a drill pipe 30 (e.g., upper portion of a drill string) and a drilling BHA 32 may extend into the wellbore 24 for operation. For example, the drill pipe 30 and the drilling BHA 32 may complete a drilling process within the wellbore 24. In certain embodiments, the drilling BHA 32 may include a variety of tools that are used to complete the drilling process. In the illustrated embodiment, the BHA 32 includes components configured to enable a directional drilling process (e.g., a drilling process configured to create a lateral section 34 of the wellbore 24). In particular, the BHA 32 includes a mud motor 36 (e.g., a bent axis mud motor), which is configured to use drilling fluid (e.g., mud) as a motive fluid to drive rotation of a drill bit 38 (e.g., a bent axis bit). The mud motor 36 may include a bend, which enables orientation of the drill bit 38 in a direction that is offset of a central axis of the wellbore 24.

The BHA 32 further includes a controlled slip connection system 40 that is coupled between the mud motor 36 and the drill pipe 30. As discussed in further detail below, the controlled slip connection system 40 includes various components configured to enable rotation of the drill pipe 30 while drilling with the mud motor 36 in a directional drilling process. In particular, the controlled slip connection system 40 enables the mud motor 36 to stay rotationally stationary or essentially rotationally stationary relative to the Earth (e.g., within 0 to 10, 1 to 8, 2 to 6, or 3 to 4 percent rotation about a circumference of the mud motor 36) of the while the drill pipe 30 is rotated by absorbing torque from the drill pipe 30 and/or converting torque from the drill pipe 30 to waste energy (e.g., heat) or hydraulic fluid flow. The controlled slip connection system 40 may also include other components configured to enable adjustment of the position (e.g., angular or rotational position) of the mud motor 36 during the directional drilling process (e.g., adjust a drilling direction of the bent axis of the mud motor 36 and the drill bit 38). As will be appreciated, the ability to rotate the drill pipe 30 while using the mud motor 36 in a directional drilling process may reduce static friction between the drill pipe 30 and the wellbore 24 and help modify the weight (e.g., force) of the drill pipe 30 acting on the drill bit 38.

Figure 2:
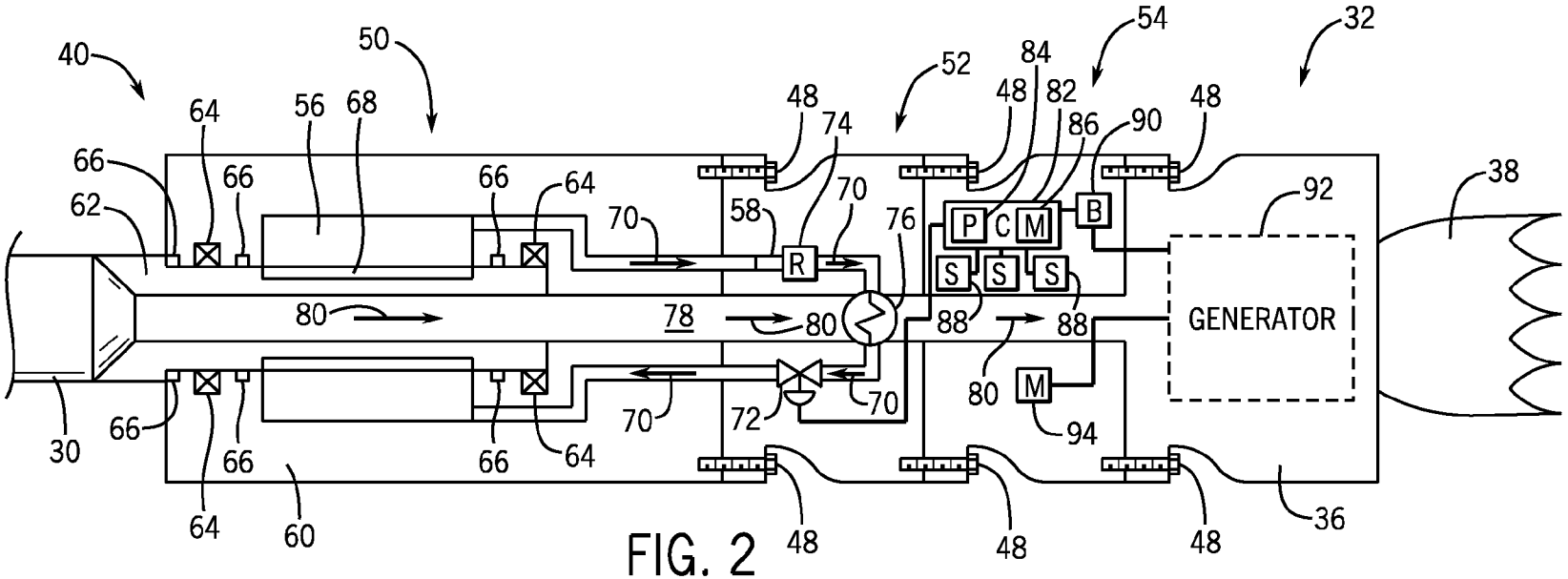
FIG. 2 is a schematic representation of an embodiment of a bottom hole assembly having a controlled slip connection system coupled between a drill string and a mud motor, in accordance with aspects of the present disclosure.

FIG. 2 is a schematic representation of the bottom hole assembly 32, illustrating the controlled slip connection system 40, the mud motor 36, and the drill bit 38, and the drill pipe 30. As mentioned above, the controlled slip connection system 40 includes components that enable the mud motor 36 to stay essentially rotationally stationary (e.g., essentially not rotating relative to the Earth) while the drill pipe 30 is rotated during a directional drilling operation within the wellbore 24. In the illustrated embodiment, the controlled slip connection system 40 includes a pump section 50, a hydraulic section 52, and a controller section 54, which are fixed to one another by mechanical fasteners 48 (e.g., bolts). Additionally, the mud motor 36 is fixed to the controller section 54 by mechanical fasteners 48. As discussed in detail below, the pump section 50, the hydraulic section 52, and the controller section 54 each include components that enable control and adjustment of an angular orientation or circular position of the mud motor 36 during a drilling operation.

In the illustrated embodiment, the pump section 50 includes a hydraulic pump or motor 56 (e.g., a vane motor) that is fluidly coupled to a hydraulic fluid circuit 58 extending from the hydraulic pump 56 and through the hydraulic section 52. The hydraulic pump 56 has a stator portion 60 that is concentric with, and extends about, a rotor portion 62, which is coupled to the drill pipe 30. Bearings 64 and seals 66 are also disposed between the stator portion 60 and the rotor portion 62. As will be appreciated, the bearings 64 facilitate and improve rotation of the rotor portion 62 relative to the stator portion 60, and the seals 66 reduce leakage of hydraulic fluid from a compression chamber 68 between the stator portion 60 and the rotor portion 62.

As the drill pipe 30 rotates, the rotor portion 62 of the hydraulic pump 56 also rotates within the stator portion 60 of the hydraulic pump 56. As will be appreciated, rotation of the rotor portion 62 causes hydraulic fluid within the compression chamber 68 of the hydraulic pump 56 to be compressed and pressurized within in the hydraulic pump 56. The compressed and pressurized hydraulic fluid may then flow through the hydraulic fluid circuit 58, as indicated by arrows 70.

The flow of the hydraulic fluid through the hydraulic fluid circuit 58 is regulated by a control valve 72 (e.g., a servo valve or an electronically controlled proportional metering valve) disposed along the hydraulic fluid circuit 58 within the hydraulic section 52. When the control valve 72 is in an opened position, the hydraulic fluid may flow freely through the hydraulic fluid circuit 58, thereby allowing unrestricted operation of the hydraulic pump 56 (e.g., allowing the rotor portion 62 and the stator portion 60 to freely rotate relative to one another). For example, as discussed below, when the control valve 72 is in a fully opened position, a resistance torque acting on the drill bit 38 and the mud motor 38 (e.g., caused by torque of the rotating drill bit 38) may cause the controller section 54, the hydraulic section 52, and the stator portion 60 of the hydraulic pump 56 to rotate in a direction opposite the direction of the drill pipe 30 and the rotor portion 62 of the hydraulic pump 56. Conversely, when the control valve 72 is in a closed position, flow of the hydraulic fluid through the hydraulic fluid circuit 58, thereby restricting and/or blocking free operation of the hydraulic pump 56 (e.g., blocking relative rotation of the rotor portion 62 and the stator portion 60). For example, when the control valve 72 is in a fully closed position, the stator portion 60 and the rotor portion 62 may "lock up" and rotate together (e.g., in the same direction and at the same speed). As a result, the controller section 54, the hydraulic section 52, and the mud motor 36 may also rotate in the same direction and at the same speed as the drill pipe 30. As discussed below, the operation of the control valve 72 may be regulated to enable adjustment of the orientation and/or position of the mud motor 36. Additionally, the operation (e.g., position) of the control valve 72 may be regulated such that the torque transferred from the drill pipe 30 to the hydraulic fluid is equal to or approximately equal to the resistance torque of the mud motor 36, which enables stationary positioning of the mud motor 36 during rotation of the drill pipe 30. As used herein and above, the term "stationary positioning" refers to the mud motor 36 being essentially non-rotating relative to the Earth. As a result, the drill pipe 30 may be rotated during a directional drilling operation, which may reduce static friction between the drill pipe 30 and the wellbore 24 and help modify the weight (e.g., force) of the drill pipe 30 acting on the drill bit 38.

Furthermore, while the controlled slip connection system 40 is useful for maintaining and/or adjusting a direction of a bent axis drill bit 38 while rotating the drill pipe 30 during a directional drilling operation, the controlled slip connection system 40 may also be used during a traditional vertical drilling operation. For example, during a vertical drilling operation, the control valve 72 may be closed, thereby blocking flow of the hydraulic fluid through the hydraulic pump 56 and hydraulic fluid circuit 58, thereby "locking up" the stator portion 60 and rotor portion 62 of the hydraulic pump 56. As a result, the torque of the drill pipe 30 may be transferred to the mud motor 36, thereby enabling the drill pipe 30 and mud motor 36 to rotate together to reduce friction between the BHA 32 and the wellbore 24.

Additional components are also disposed along the hydraulic fluid circuit 58. For example, the hydraulic fluid circuit 58 includes a reservoir 74, which is a compartment that enables additional hydraulic fluid to be stored and flow through the hydraulic fluid circuit 58. In certain embodiments, the reservoir 74 may be accessible from an exterior of the hydraulic section 52 to enable flushing and replacement of the hydraulic fluid within the hydraulic fluid circuit 58. The hydraulic fluid circuit 58 also includes a heat exchanger 76. In particular, the heat exchanger 76 is positioned along the hydraulic fluid circuit 58 within a central mud flow passage 78 of the controlled slip connection system 40. During a drilling process, drilling mud is pumped through the drill pipe 30 and through the central mud flow passage 78 of the controlled slip connection system 40 to the mud motor 36, as indicated by arrows 80. As the drilling mud passes across the heat exchanger 76, heat may be exchanged between the hydraulic fluid flowing through the hydraulic fluid circuit 58 and the mud flowing through the central mud flow passage 78. More specifically, heat may be transferred from the hydraulic fluid, which increases in temperature as it is compressed and pressurized by operation of the hydraulic pump 56, to the mud flowing through the central mud flow passage 78. In this manner, at least a portion of the torque of the drill pipe 30 transferred to the hydraulic fluid may be discharged as waste heat.

The controller section 54 of the controlled slip connection system 40 includes a variety of components configured to enable monitoring and adjustment of the position of the controlled slip connection system 40 and the mud motor 36. For example, the controller section 54 includes a controller 82 configured to regulate operation of the control valve 72 disposed along the hydraulic fluid circuit 58. In other words, the controller 82 is configured to regulate a position of the control valve 72 to adjust the flow of hydraulic fluid through the hydraulic fluid circuit 58. In the illustrated embodiment, the controller 82 includes a processor (e.g., a microprocessor) 84 and a memory 86. The memory 86 is a non-transitory (not merely a signal), computer-readable media, which may include executable instructions that may be executed by the processor 84. For example, the executable instructions stored on the memory 86 may include instructions for control signals to be applied by the controller 82 based on feedback received from one or more sensors 88 of the controller section 54. As mentioned above, the controller 82 may be configured to control operation of the control valve 72 based on a detected or measured position or orientation (e.g., angular, circular, or rotational position) of the controlled slip connection system 40. As such, the sensors 88 may include a magnetometer, an accelerometer, gyroscope, gravitational sensor, azimuth sensor, another type of position sensor, or any combination thereof. Based on the measured position or orientation (e.g., circular position and/or angular orientation) of the controlled slip connection system 40, the controller 82 may adjust the position of the control valve 72 to increase the flow of hydraulic fluid in the hydraulic fluid circuit 58, thereby allowing free operation of the hydraulic pump 56 and enabling counter-rotation of the controlled slip connection system 40 and the mud motor 36 relative to the drill pipe 30, or decrease the flow of hydraulic fluid, thereby restricting operation of the hydraulic pump 56 and enabling co-rotation of the drill pipe 30, the controlled slip connection system 40 and the mud motor 36. In certain embodiments, the controller 82 may also be configured to communicate operating parameters of the controlled slip connection system 40, such as parameters measured by the sensors 88, to a system (e.g., a user interface) at a surface of the well 10.

The BHA 32 (e.g., the controlled slip connection system 40 and the mud motor 36) may also include other components. For example, in the illustrated embodiment, the controller section 54 includes a battery 90, which may provide power to the controller 82 and the sensors 88. In other embodiments, the mud motor 36 may include a generator 92 in addition to or instead of the battery 90. The generator 92 may use a flow of drilling mud from the drill pipe 30 to drive a turbine or other device configured to generate electrical power for powering the various components of the controller section 54 (e.g., the controller 82 and the sensors 88). In certain embodiments, the power produced by the generator 92 may be used to recharge the battery 90. The controller section 54 also includes a motor 94, which may be used to drive other components of the controlled slip connection system 40 or BHA 32.

As mentioned above, the controlled slip connection system 40 may include other components to control torque transfer between the drill pipe 30 and the mud motor 36 in place of the hydraulic pump 56 and hydraulic fluid circuit 58. For example, the controlled slip connection 40 may include a mechanical clutch system, an electromagnetic system, and electrical generator system, another type of variable or constant displacement pump, or other system configured to variably absorb and/or transfer torque from the drill pipe 30. Additionally, in such embodiments, the controlled slip connection system 40 may include other components (e.g., sensors, controllers, etc.) to control operation of the torque transfer systems to enable monitoring and adjustment of the position of the mud motor 36.

FIG. 3 is a free body diagram of an embodiment of the bottom hole assembly 32 having the controlled slip connection system 40 coupled between the drill pipe 30 and the mud motor 36. As discussed above, the controlled slip connection system 40 is configured to regulate and adjust torque transfer between the drill pipe 30 and the mud motor 36 to adjust and/or maintain a desired position (e.g., angular or circular position) of the mud motor 36 relative to the Earth during a drilling operation (e.g., a directional drilling operation).

As indicated by arrow 100, during a directional drilling operation, the drill pipe 30 is rotated to help reduce friction between the drill pipe 30 and the wellbore 24. Similarly, the drill bit 38 is driven into rotation, as indicated by arrow 102, by the mud motor 36 during a directional drilling operation. The controlled slip connection system 40 (e.g., a processor of the controlled slip connection system 40) uses sensors 88 (e.g., gravitational sensors) to detect a gravitational force, indicated by arrow 104, acting on the controlled slip connection 40, and the controlled slip connection system 40 (e.g., a processor of the controlled slip connection system 40) uses the detected gravitational force as a reference point for determining and adjusting a direction of the bent axis of the drill bit 38. In other words, the sensors 88 of the controlled slip connection system 40 measure the angular (e.g., rotational) position or orientation of the controller section 54 and the mud motor 36 relative to the Earth. Based on changes in the measured position or orientation of the controller section 54 of the mud motor 36, the controller 82 may then adjust the position of the control valve 72 to adjust the torque transferred to the mud motor 36 by the controlled slip connection system 40 in the manner described above, thereby adjusting the position or orientation of the mud motor 36 to adjust the direction of directional drilling.

FIG. 4 is another free body diagram the BHA 32 of FIG. 3, illustrating an axial view of the BHA 32. As mentioned above, the sensors 88 (e.g., accelerometer) of the controller section 54 of the controlled slip connection system 40 may detect a gravitational force acting on the controlled slip connection system 40, and the controller 82 may use the detected gravitational force as a reference point to determine position or orientation of the controller section 54 and the mud motor 36. During a directional drilling operation where the drill pipe 30 is rotated, the controlled slip connection system 40 slips at the rotational rate of the drill pipe 30 to keep the mud motor 36 and the drill bit 38 essentially stationary (e.g., not rotating relative to the Earth within a tolerance).

If the stationary portion of the controlled slip connection system 40 (e.g., the stator portion 60 of the pump section 50, the hydraulic section 52, and the controller section 54), which is fixed to the mud motor 36, rotates clockwise or counterclockwise beyond a threshold or set point, the controller 82 may adjust the position of the control valve 72 to adjust the torque transferred from the drill pipe 30 to the controlled slip connection system 40 and the mud motor 36 to adjust the position or orientation of the mud motor 36. For example, in FIG. 4, the gravitational force measured by the sensors 88 is represented by arrow 120. The angular position of the mud motor 36 at which the sensors 88 detect the gravitational force 120 may correspond to a desired or target angle of the bent axis mud motor 36. If the mud motor 36 rotates in a direction 122 past a threshold point 124, the controller 82 may adjust the position of the control valve 72 to adjust the torque transferred from the drill pipe 30 to the mud motor 36 by the controlled slip connection system 40. More specifically, the control valve 72 may be closed to reduce flow of hydraulic fluid through the hydraulic fluid circuit 58. As a result, the hydraulic pump 56 will "lock up" and the controlled slip connection system 40 and the mud motor 36 will rotated with the drill pipe 30 in the drilling direction 100 (i.e., direction 126). Conversely, if the mud motor 36 rotates in direction 126 past a threshold 128, the control valve 72 may be opened to enable a greater flow of hydraulic fluid through the hydraulic fluid circuit 58, which will decrease torque transfer from the drill pipe 30 to the mud motor 36 and will allow rotation of the mud motor 36 in the reverse drilling direction (i.e., direction 122). In either situation, once the sensors 88 (e.g., accelerometer) detect the gravitational force in the direction 120 at the rotational position of the BHA 32 shown in FIG. 3, the control valve 72 may again be adjusted such that the controlled slip connection system 40 slips at the rate of the drill pipe 30 to keep the mud motor 36 stationary (e.g., non-rotating). In other words, at an "equilibrium" position of the control valve 72, the controlled slip connection system 40 generates a resistance torque equal or approximately equal to the torque of the rotating drill bit 38 to enable the rotating drill bit 36 to react against the controlled slip connection system 40 while the mud motor 36 remains stationary. In this manner, the direction of the bent axis drill bit 38 may be maintained and controlled while rotating the drill pipe 30 during a directional drilling operation to obtain the friction-reducing benefits of drill pipe 30 rotation.

Furthermore, as discussed above, when the control valve 72 is in a position such that the controlled slip connection system 40 slips at the rate of the drill pipe 30 and the mud motor 36 is kept stationary, at least a portion of the torque of the rotating drill pipe 30 is transferred to the hydraulic fluid as waste heat. The heat of the hydraulic fluid may then be transferred to the drilling mud flowing through the central mud flow passage 78 by the heat exchanger 76 shown in FIG. 2.

As discussed in detail above, the present disclosure relates generally to the controlled slip connection system 40 coupled between an upper portion of the drill pipe 30 and the mud motor 36 and drill bit 38. The controlled slip connection system 40 is configured to allow the upper portion of the drill pipe 30 to continually rotate, which provides the desirable dynamic friction realm that is available during straight or vertical drilling runs, during a directional drilling operation. The controlled slip connection system 40 also provides a rotationally stationary surface for the mud motor 36 to react against regardless of the drill pipe 30 speed of rotation or position. In certain embodiments, the controlled slip connection system 40 includes the pump section 50 with hydraulic pump 56, the hydraulic section 52 with the hydraulic circuit 58, and the controller section 54, which is configured to regulate a flow of hydraulic fluid through the hydraulic fluid circuit 58 and the hydraulic pump 56 to control an amount of torque transferred from the drill pipe 30 to the mud motor 36. However, other embodiments of the controlled slip connection system 40 may include an electrical generator with a controlled variable resistive load, a mechanical clutch with control over a breaking torque or other energy reducing rotary connection, or other component configured to enable and control absorption of torque and/or torque transfer from the upper portion of the drill pipe 30 to the mud motor 36. As a result, the drill pipe 30 may be rotated during a directional drilling operation, which may reduce static friction between the drill pipe 30 and the wellbore 24 and help modify (e.g., reduce) the weight (e.g., force) of the drill pipe 30 acting on the mud motor 36 and drill bit 38.

While only certain features of present embodiments have been illustrated and described herein, many modifications and changes will occur to those skilled in the art. It is, therefore, to be understood that the appended claims are intended to cover all such modifications and changes as fall within the true spirit of the disclosure.

The invention claimed is:

1. A device, comprising:

a slip connection system configured to be coupled between a drill pipe and a directional drilling assembly, wherein the slip connection system comprises:

a closed loop hydraulic fluid circuit configured to flow a hydraulic fluid;

a hydraulic fluid valve disposed along the closed loop hydraulic fluid circuit, wherein the hydraulic fluid valve is configured to regulate a flow rate of the hydraulic fluid through the hydraulic fluid circuit; and a heat exchanger disposed along the closed loop hydraulic fluid circuit within a central mud flow passage of the slip connection system, wherein the heat exchanger is configured to exchange heat between the hydraulic fluid and a mud flow, wherein the slip connection system is configured to enable continual rotation of the drill pipe while providing a rotationally stationary surface for a mud motor of the directional drilling assembly to react against.

2. The device of claim 1, wherein the slip connection system comprises:

a hydraulic pump configured to transfer energy from rotational movement of the drill pipe to the hydraulic fluid.

3. The device of claim 1, wherein the slip connection system comprises:

a controller section configured to regulate operation of the hydraulic fluid valve.

4. The device of claim 3, wherein the controller section comprises:

at least one sensor configured to measure or detect an operating parameter of the slip connection system; and a controller configured to regulate operation of the hydraulic fluid valve based on the operating parameter.

5. The device of claim 4, wherein the at least one sensor is an accelerometer, a gravitational sensor, an azimuth sensor, a gyroscope, or any combination thereof.

6. The device of claim 4, wherein the operating parameter is a circular position of the slip connection system, an angular position of the slip connection system, a circumferential orientation of the slip connection system, or any combination thereof.

7. The device of claim 4, wherein the controller section comprises a battery configured to supply power to the controller, and the mud motor comprises a generator coupled to the battery, wherein the generator is configured to generate supplemental power from a mud flow to recharge the battery.

8. The device of claim 2, wherein the hydraulic pump comprises a rotor portion coupled to the drill pipe and a stator portion coupled to the mud motor.

9. The device of claim 1, wherein the slip connection system comprises a hydraulic pump, a clutch disk system, an electrical generator comprising a variable resistance load, a vane motor, or any combination thereof to variably absorb torque from the drill pipe.

10. A controlled slip connection system, comprising:

a pump section configured to couple to a drill pipe, wherein the pump section comprises a hydraulic pump;

a hydraulic section coupled to the pump section, wherein the hydraulic section comprises a hydraulic fluid circuit configured to circulate a hydraulic fluid flow of the hydraulic pump; and a controller section coupled to the hydraulic section, wherein the controller section is configured to couple to a mud motor of a directional drilling assembly, wherein the controlled slip connection system is configured to slip at a rotational rate of the drill pipe, and wherein the controlled slip connection system is configured to couple axially between the mud motor of the directional drilling assembly and the drill pipe, wherein the pump section, the hydraulic section, and the controller section cooperatively define a central mud flow passage configured to flow a drilling mud flow from the drill pipe to the mud motor, and wherein heat is exchanged between the hydraulic fluid flow and the drilling mud flow with a heat exchanger disposed along the hydraulic fluid circuit and within the central mud flow passage.

11. The controlled slip connection system of claim 10, wherein the hydraulic pump comprises a rotor portion configured to couple to the drill pipe and a stator section coupled to the hydraulic section.

12. The controlled slip connection system of claim 11, wherein the hydraulic fluid circuit comprises a hydraulic fluid reservoir and an electronically controlled proportional metering valve.

13. The controlled slip connection system of claim 12, wherein the controller section comprises:

a controller configured to regulate operation of the electronically controlled proportional metering valve;

a plurality of sensors configured to detect an angular orientation of the controlled slip connection system; and a battery configured to provide power to the controller and the plurality of sensors, wherein the controller is configured to regulate operation of the electronically controlled proportional metering valve based on the angular orientation of the controlled slip connection system.

14. A method of positioning a drill string within a wellbore comprising:

detecting an orientation of a controlled slip connection system coupled between a drill pipe and a mud motor of the drill string with at least one sensor;

rotating the drill pipe;

adjusting a flow rate of hydraulic fluid in a hydraulic fluid circuit in fluid communication with a hydraulic pump coupled to the drill pipe with a controller in order to adjust torque transfer between the drill pipe and the controlled slip connection system wherein adjusting torque transfer between the drill pipe and the controlled slip connection system adjusts the orientation of the controlled slip connection system;

pumping a drilling mud flow through the drill pipe and the controlled slip connection system to the mud motor via a central mud flow passage; and exchanging heat between the hydraulic fluid and the drilling mud flow with a heat exchanger disposed along the hydraulic fluid circuit and within the central mud flow passage.

15. The method of claim 14, wherein detecting the orientation of the controlled slip connection system comprises detecting an angular position, a circumferential orientation, or a circular position of the controlled slip connection system with the at least one sensor.

16. The method of claim 14, wherein adjusting the flow rate of hydraulic fluid in the hydraulic fluid circuit comprises adjusting a position of an electronically controlled proportional metering valve disposed along the hydraulic fluid circuit with the controller.

17. The method of claim 14, comprising flowing the drilling mud flow through a generator disposed in the mud motor to generate power for at least one component of the controlled slip connection system.

* * * * *